US007441681B2

(12) United States Patent
Butsch et al.

(10) Patent No.: US 7,441,681 B2
(45) Date of Patent: Oct. 28, 2008

(54) APPARATUS FOR SEPARATING A WEB MATERIAL

(75) Inventors: William Joseph Butsch, Harrison, OH (US); Stephen Rainey Addison, Leesburg, GA (US)

(73) Assignee: The Procter & Gamble Company, Cincinnati, OH (US)

( * ) Notice: Subject to any disclaimer, the term of this patent is extended or adjusted under 35 U.S.C. 154(b) by 152 days.

(21) Appl. No.: 10/652,325

(22) Filed: Aug. 29, 2003

(65) Prior Publication Data

US 2005/0045008 A1 Mar. 3, 2005

(51) Int. Cl.
*B26F 3/02* (2006.01)
*B65H 35/10* (2006.01)

(52) U.S. Cl. ..... 225/100; 225/105; 225/106; 83/347; 83/660; 242/521; 242/526.1

(58) Field of Classification Search ..... 242/521, 242/526, 526.1, 527, 527.1, 5, 584, 523.1, 242/580; 225/1, 2, 4, 5, 93, 100, 103–106
See application file for complete search history.

(56) References Cited

U.S. PATENT DOCUMENTS 3,179,348 A * 4/1965 Nystrand et al. ..... 242/527.1
3,293,970 A 12/1966 Brockmuller
3,567,552 A 3/1971 Heuff et al.
RE28,353 E * 3/1975 Nystrand et al. ..... 242/527.1
4,487,377 A 12/1984 Perini
4,687,153 A 8/1987 McNeil
4,919,351 A 4/1990 McNeil
5,248,106 A 9/1993 Biagiotti
5,285,977 A 2/1994 Biagiotti
5,335,869 A 8/1994 Yamaguchi et al.
5,402,960 A 4/1995 Oliver et al.
5,620,151 A 4/1997 Ueyama et al.
5,639,046 A 6/1997 Biagiotti
5,950,958 A 9/1999 Eronen
5,979,818 A 11/1999 Perini et al.
6,016,989 A 1/2000 Gangemi
6,086,010 A 7/2000 Kayser
6,179,241 B1 * 1/2001 Ba Dour, Jr. et al. ..... 242/527.1
6,494,398 B1 12/2002 De Matteis et al.

(Continued)

FOREIGN PATENT DOCUMENTS

EP 0 386 819 9/1990

(Continued)

*Primary Examiner*—Clark F. Dexter
(74) *Attorney, Agent, or Firm*—Peter D. Meyer; David K. Mattheis

(57) ABSTRACT

An apparatus and method for separating a web material are disclosed herein. The apparatus includes a bedroll and a chop off roll. The bedroll includes a bedroll blade and a bedroll web pin. The chop off roll includes a pin pad and a plurality of chop off roll blades. The bedroll web pin, and the bedroll blade, mesh with the pin pad and the chop off roll blades. The chop off roll blades are moved relative to the bedroll blade, stretching and separating the web material. The web pin perforates the web material and may completely or partially separate a portion of the web material. The web pin and the separated portion perforate the pin pad. The separated portion is stripped from the web pin as the pin passes out of the pin pad.

6 Claims, 4 Drawing Sheets

U.S. PATENT DOCUMENTS

| | | | | |
|---|---|---|---|---|
| 6,526,854 | B1 | 3/2003 | Kytönen | |
| 6,648,266 | B1 | 11/2003 | Biagiotti et al. | |
| 6,669,617 | B1 | 12/2003 | Sumida et al. | |
| 6,805,316 | B2 * | 10/2004 | Wojcik et al. | 242/527.1 |
| 6,851,642 | B2 | 2/2005 | Wilson et al. | |
| 2003/0111572 | A1 | 6/2003 | Wilson et al. | |

FOREIGN PATENT DOCUMENTS

| | | |
|---|---|---|
| EP | 0 625 476 | 11/1994 |
| GB | 1 589 920 | 5/1981 |

* cited by examiner

APPARATUS FOR SEPARATING A WEB MATERIAL

FIELD OF THE INVENTION

This invention relates to an apparatus for separating a web material. More particularly, the invention relates to an apparatus for separating a web material along a line of weakness.

BACKGROUND OF THE INVENTION

Web materials are a ubiquitous part of daily life. Metal foils, plastic films, plastic bags, paper toweling, bath tissue, facial tissues, thread, wire and rope are all web materials. The manufacturing of these web materials often requires the formation of small discrete rolls of the web material from a large source roll, or parent roll. The formation of the small rolls requires the separation of the web material into smaller lengths corresponding to the quantity of web material desired for the small roll.

The web material as it is provided in the small roll often comprises lines of weakness that are transverse to the length of the web material to facilitate further separation of the web material into discrete segments for use by the consumer. It is desirable to separate the web material at a line of weakness when a first small roll is completed and prior to the beginning of a subsequent small roll. The separation of the material at a line of weakness yields a more uniform appearing roll and more efficient handling of the web material during the processing from a parent roll into small rolls.

SUMMARY OF THE INVENTION

An apparatus and method for separating a web material is described herein. In one embodiment the apparatus comprises a bedroll. The bedroll is disposed such that web material passes around at least a portion of the circumference of the bedroll in a direction of travel. The bedroll is disposed to axially extend generally transverse to the direction of travel. The bedroll comprises a shell and a bedroll chop off assembly. The bedroll chop off assembly comprises at least one web pin and at least one blade. The at least one blade is disposed to extend axially along the bedroll in a direction generally transverse to the direction of travel and oriented with a blade tip directed away from the center of the bedroll shell. The blade tip and a tip of the web pin are capable of extending beyond the circumference of the shell of the bedroll. The bedroll is capable of rotating at a first circumferential speed.

The apparatus further comprises a chop off roll. The chop off roll is disposed proximally to the bedroll and generally parallel to the bedroll. The chop off roll comprises at least one pin pad and at least two blades. The pin pad is capable of circumferentially interfering with at least one of the web pins of the bedroll. The blades are disposed to extend axially along the chop off roll in a direction generally transverse to the direction of travel of the web. The two blades are disposed at a chop off blade spacing. The two blades are capable of rotationally meshing with at least one of the bedroll blades. The chop off roll is capable of rotating at a second circumferential speed that is distinct from the first circumferential speed.

In another aspect, the invention comprises a method for separating a web material along a line of weakness. The method comprises steps of providing a bedroll as set forth above, and providing a chop off roll disposed proximal to the bedroll and generally parallel to the bedroll. The chop off roll is spaced apart from the bedroll by a chop off gap. The method further comprises steps of rotating the bedroll at a first circumferential speed, and rotating the chop off roll at a second circumferential speed. The second circumferential speed is distinct from the first circumferential speed. The web material is routed through the chop off gap. The web material is perforated by the web pin and the web material and web pin perforate at least a portion of a pin pad. The chop off blades and at least one bedroll blade rotationally mesh and the web is separated.

BRIEF DESCRIPTION OF THE DRAWINGS

While the claims hereof particularly point out and distinctly claim the subject matter of the present invention, it is believed the invention will be better understood in view of the following detailed description of the invention taken in conjunction with the accompanying drawings in which corresponding features of the several views are identically designated and in which:

All references cited in the following detailed description of the invention are hereby incorporated herein by reference.

DETAILED DESCRIPTION OF THE INVENTION

Figure 1:
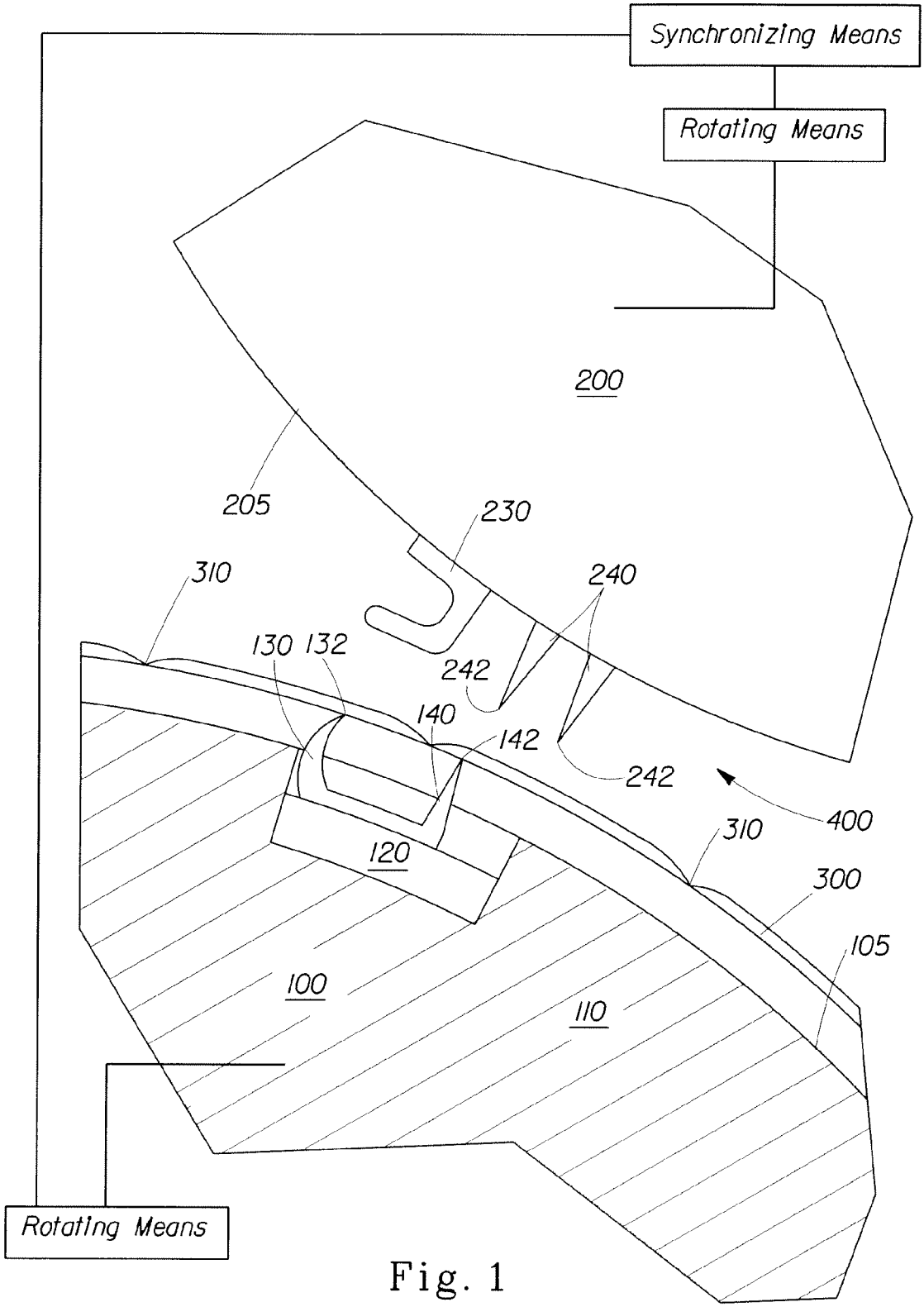
FIG. 1 is a schematic side view of a portion of a bedroll and chop off roll of one embodiment of the invention.

FIG. 1 illustrates an embodiment of the apparatus of the invention. As shown in the figure, the apparatus comprises a bedroll 100, and a chop off roll 200. The bedroll 100 and chop off roll 200 are generally cylindrical and are disposed generally parallel to each other. A gap 400 is present between the outer circumference 105 of the bedroll 100 and the outer circumference 205 of the chop off roll 200. A web material 300 is routed through the gap 400 between the bedroll 100 and the chop off roll 200 and around at least a portion of the circumference 105 of the bedroll 100. The web material proceeds through the gap 400 in a direction of travel. The bedroll 100 and the chop off roll 200 are disposed generally transverse to the direction of travel of the web material 300.

The web material 300 may comprise any web material known in the art. Exemplary web materials include without being limiting, wire, rope, thread, paper webs including tissue and hard grades of paper, metal foils, plastic and celluloid films. The web material 300 is characterized by having one dimension much greater than the other two dimensions. The web material 300 may have a first dimension (length) and a second dimension (width) each much greater than a third dimension (thickness). The web material may comprise lines of weakness 310 generally transverse to the length of the web material 300. A line of weakness 310 comprises a portion of the web material 300 having a tensile strength along the length of the web material 300 that is measurably less than the tensile strength of other portions of the web material 300. During the processing of the web material 300 it is often desirable to separate the web material 300 at a line of weakness 310.

Figure 2:
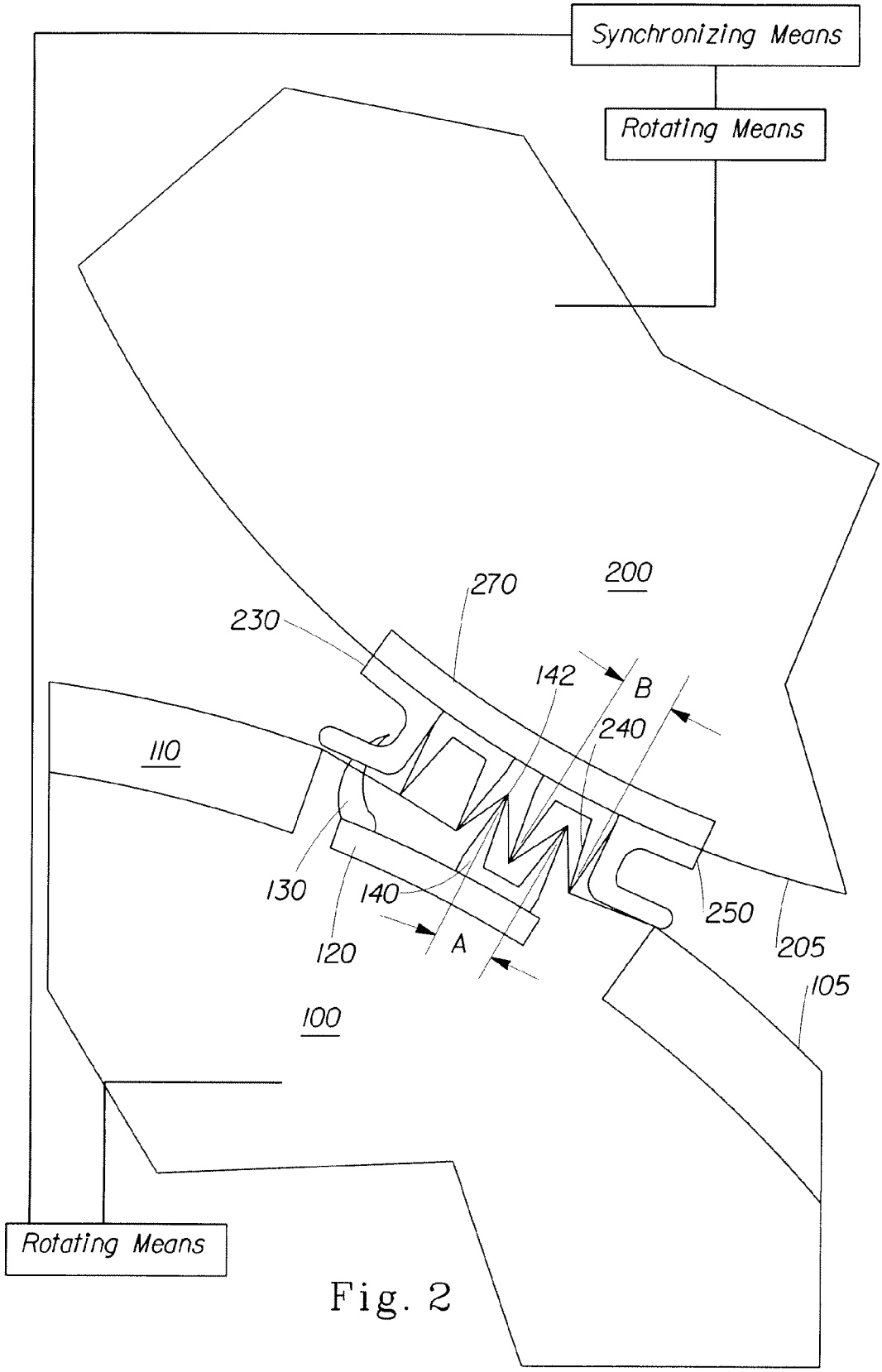
FIG. 2 is a schematic side view of a portion of a bedroll and chop off roll according to another embodiment of the invention.

The bedroll 100 comprises a shell 110 and a bedroll chop off assembly 120. The bedroll chop off assembly 120 is movable from a first position to a second position through the action of at least one cam and cam follower combination as is known in the art. The bedroll chop off assembly 120 comprises at least one web pin 130, and at least one blade 140. The web pin 130 is disposed proximally to the blade 140 and comprises a pin tip 132. The bedroll chop off assembly 120 may comprise a plurality of web pins 130 disposed generally along a line generally transverse to the direction of travel of the web material 300. The blade 140 is disposed to extend axially along the bedroll in a direction generally transverse to the direction of travel of the web material 300 and comprises a blade tip 142. In one embodiment shown in FIG. 1, the bedroll chop off assembly 120 comprises a single blade 140. In another embodiment shown in FIG. 2, the chop off assembly 120 comprises two blades 140. In another embodiment (not shown), the bedroll chop off assembly 120 comprises three blades 140. Still other embodiments comprising more than three blades 140 are within the scope of the invention. In each embodiment comprising a plurality of blades 140, the blades 140 are disposed to extend generally transverse to the direction of travel of the web material 300 and are generally parallel to each other separated by a bedroll blade spacing, A.

As the bedroll chop off assembly 120 moves from the first position to the second position, the web pin tip 132 and the blade tip 142 move from a radial position that is within the circumference of the shell 110 of the bedroll 100 to a radial position that is beyond the shell 110 of the bedroll 100. In this second position, the web pin tip 132, and the blade tip 142, interfere with the plane of the web material 300 as the web material, the blade and the web pin pass through the gap 400.

The bedroll 100 is capable of powered rotating about its axis. This powered rotation may be achieved by any means that is known in the art. As the bedroll 100 rotates, the blade 140 and web pin 130 move past the gap 400 at a first circumferential velocity depending upon the rotational speed of the bedroll 100 and the radial location of the bedroll chop off assembly 120. The blade 140 and web pin 130 are disposed in the bedroll chop off assembly 120 such that as the bedroll 100 rotates, the blade 140 passes through the gap 400 followed by the web pin 130. The circumferential velocity is determined as the tangential speed at the radial position defined by the blade tip 142.

The chop off roll 200 comprises at least one pin pad 230. The pin pad 230 is disposed in alignment with the web pin 130 of the bedroll 100. The pin pad 230 and the web pin 130 interfere with each other and the web pin tip 132 perforates at least a portion of the pin pad 230 as the pin pad 230 and the web pin 130 pass together through the gap 400. In another embodiment (not shown), the chop off roll 200 comprises a plurality of pin pads 230 disposed along a line generally transverse to the direction of travel of the web material 300. In this embodiment, the pin pads 230 are aligned with the web pins 130 located on the bedroll chop off assembly 120.

Figure 3:
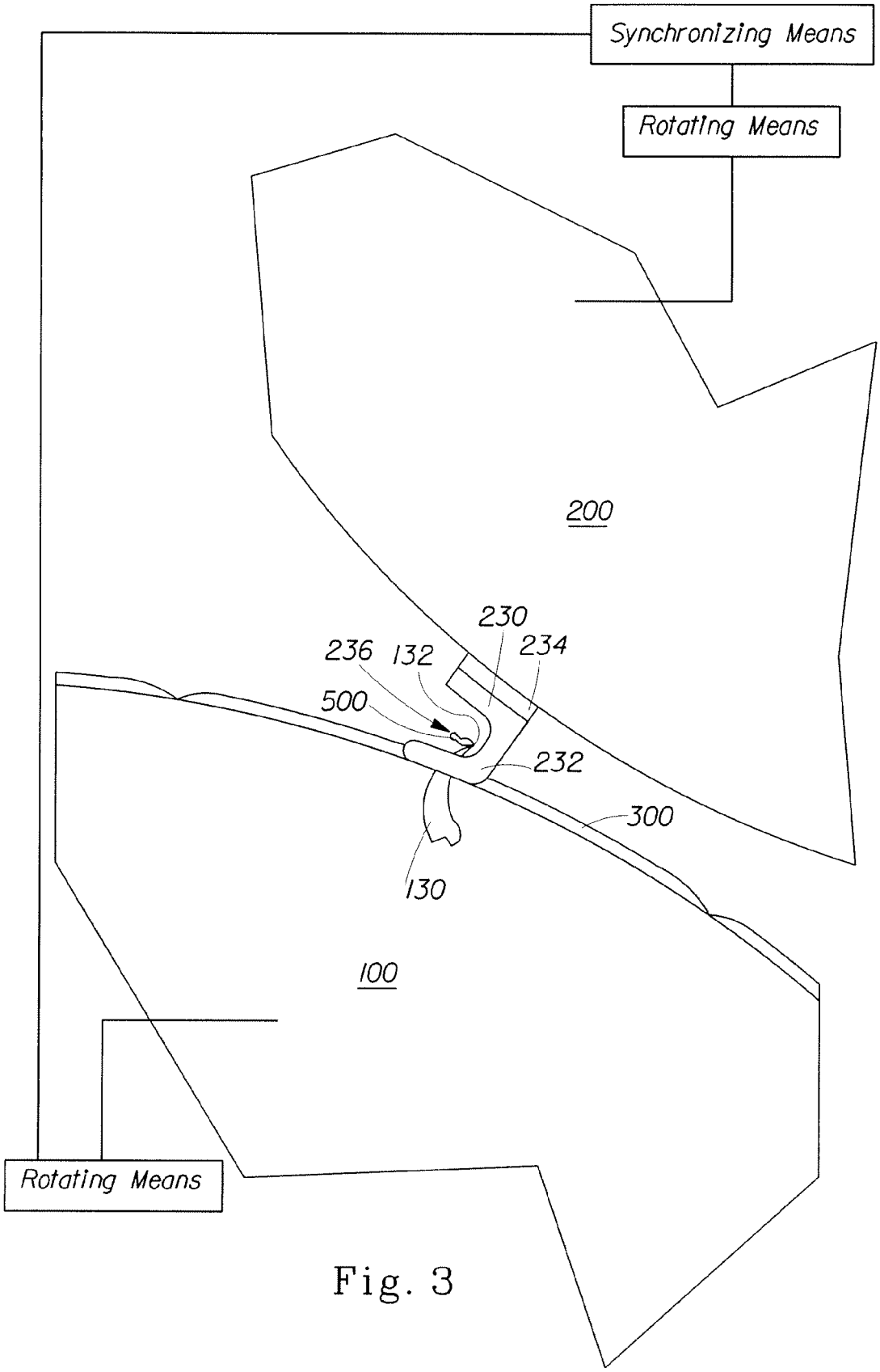
FIG. 3 is schematic side view of a pin pad and web pin according to the invention.

As shown in FIG. 3, the pin pad 230 comprises a first portion 232 comprising a resilient material, and a second portion 234. The first portion 232 and/or the second portion 234 define an open chamber 236. The second portion 234 may comprise a resilient material or may comprise a non-resilient material. Exemplary resilient materials include closed cell polyester foam, and urethane materials. Exemplary non-resilient materials include metal substrates such as steel, copper, tin and aluminum, polycarbonates, acrylics and other polymeric materials as are known in the art. The first portion 232 is fixedly attached to the second portion 234. The first portion 232 is disposed on the chop off roll 200 at a radial position that will interfere with the web pin tip 132. The shape of the pin pad 230 facilitates the perforation of a portion of the pin pad 230 by the web pin 130 and by any web chad 500 separated from the main web 300 by the web pin 130. The web chad 500 and the web pin tip 132 pass into the chamber 236 of the pin pad 230. The pin pads may be provided individually or as a plurality of pin pads formed in an assembly. The pin pad 230 may be fastened to the chop off roll 200 by any means known in the art. Mechanical fasteners, such as nails, screws, rivets, adhesives, clamping mechanisms, or sliding dovetail fasteners are non-limiting examples of means for fastening the pin pads 230.

The chop off roll 200 further comprises at least two blades 240. The blades 240 are disposed to extend axially along the chop off roll in a direction generally transverse to the direction of travel of the web material 300 and generally parallel to each other and separated by a chop off roll blade spacing, B. One blade 240 is disposed proximal to the pin pad 230. In an embodiment comprising a plurality of pin pads 230, one blade is disposed parallel to the line along which the plurality of pin pads 230 are disposed. The blades 240 each comprise a blade tip 242. In another embodiment the chop off roll 200 comprises three blades 240. Embodiments wherein the chop off roll 200 comprises more than three blades are within the scope of the invention. The blades 240 may be provided as single blades, or the blades 240 may be provided as pairs through u-channels.

Figure 4:
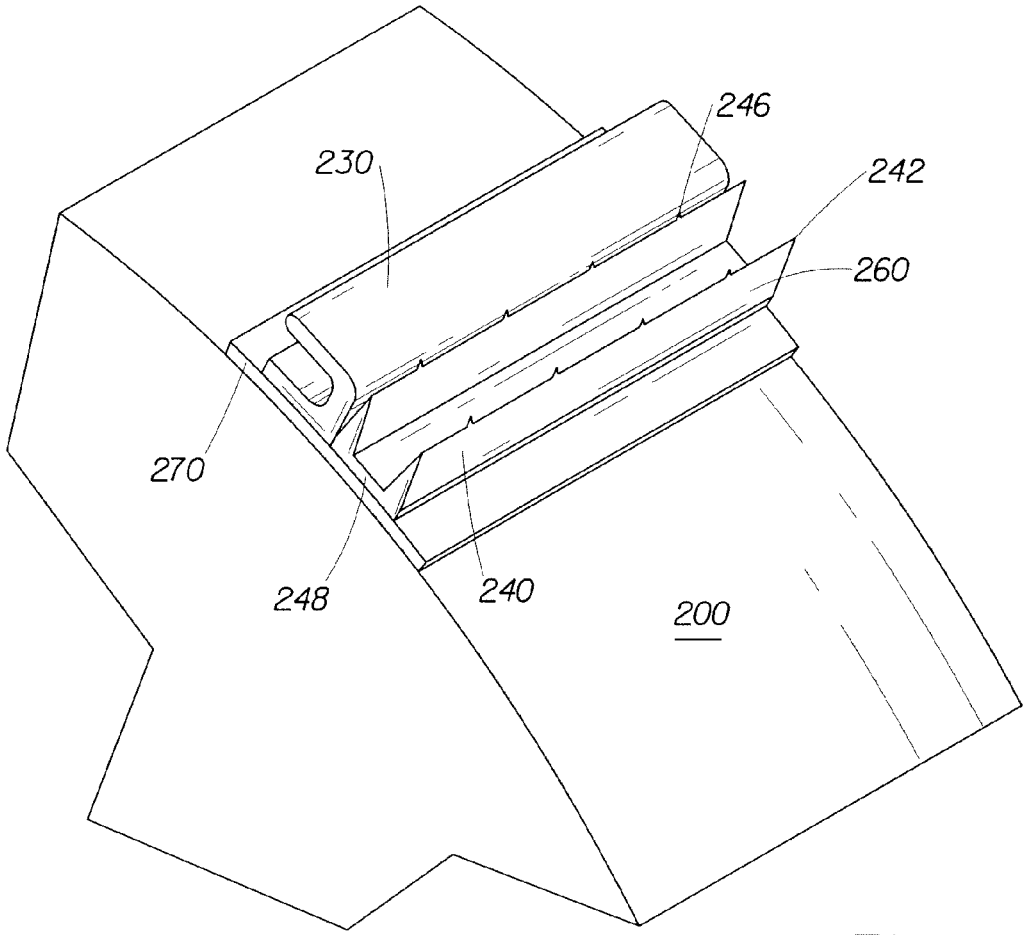
FIG. 4 is a schematic view of a portion of a chop off roll blade according to one embodiment of the invention.

The u-channel 260 illustrated in FIG. 4 comprises two blades 240, and a connecting element 248. As shown in the figure, the u-channel 260 is attached to a blade head 270 together with the pin pad 230. The blade head 270 is attached to the chop off roll 200. The chop off roll 200 is capable of powered rotation about its axis. This powered rotation may be achieved by any means for rotating a cylindrical roll as are known in the art. The blades 240 and pin pad 230 are disposed relative to each other such that as the chop off roll 200 rotates, the blades 240 pass through the gap first followed by the pin pad 230. The chop off roll 200 rotates at a second circumferential speed corresponding to the tangential speed of the circumference defined by the radial position of the blade tips 242.

The rotation of the bedroll 100 is synchronized with the rotation of the chop off roll 200 by means known in the art. The synchronized rotation yields a meshing of the blade 140 of the bedroll 100 between the blades 240 of the chop off roll 200 as the blades 140 and 240 pass through the gap. The radial positions of the bedroll blade tip 142 and the chop off roll blade tips 242 interfere with each other. The position of the bedroll blade 140 and the chop off roll blades 240 must be maintained such that the blades 140 and 240 do not occupy the same space when passing through the gap 400.

In one embodiment, the radius of the chop off roll 200 is similar to the radius of the bedroll 100. The similarity of radii facilitates a large depth of engagement between the bedroll blade 140 and the chop off roll blade 240 as the respective blades mesh in the gap 400. This large depth of engagement facilitates a greater stretching of the web 300 as the blades mesh.

The circumferential velocity of the blade tips 142 and 242 are maintained at different velocities as the tips 142 and 242 pass through the gap 400. The differing blade tip velocities yield relative motion between the blade 140 and blades 240 as the blades mesh. This relative motion may be used to separate the web material 300 at a line of weakness 310.

The blades 140 and 240 may each comprise a single blade segment. In another embodiment, each blade may comprise a plurality of blade segments. In this embodiment, the blade segments may be disposed adjacent each to the next along a line generally transverse to the direction of travel with little if any spacing between the segments in the direction transverse to the direction of travel. In another embodiment, the blade segments may be spaced apart by a segment gap. The segment gap may range from 0.125 to 2 inches (3 to 50 mm). In another embodiment the segment gap may range from 0.5 to 1.5 inches (12 to 37 mm). The segment gap varies according to the nature of the web material and the separation characteristics of the web material 300. Blades comprising a plurality of spaced apart blade segments require less material and facilitate the removal and replacement of a damaged segment without the necessity of replacing an entire blade. As described above, the blades may be provided as single blades or as a u-channel.

As shown in FIG. 4, the blades 240 may comprise a serrated web contacting edge at the blade tins 242. The serrations 246 of the web contacting edge may stabilize the position of the web material and facilitate the stretching of the web material 300 and subsequent failure of the line of weakness 310. In an alternative embodiment, the blade 140 may comprise a serrated web contacting edge (not shown).

The chop off roll 200 may further comprise a web pad 250 or plurality of web pads 250. The web pad is disposed adjacent to the blades 240 and comprises an outer surface disposed radially at a distance about equal to the radial position of the blade tip 242. The web pads 250 are disposed generally along a line transverse to the direction of travel of the web material 300, and downstream from the blades 240 on the circumference 205 of the chop off roll 200.

As the web pads 250, blades 140 and 240, web pins 130 and pin pads 230 pass sequentially through the gap 400, the web pads 250 press the web material 300 against the circumference 105 of the bedroll shell stabilizing the position of the web material 300 as the blades 140 and 240 mesh to constrain the web material to ultimately yield the failure of the web material 300 at a line of weakness 310.

Method of Use:

The use of the above described apparatus comprises routing a web material 300 around a portion of the circumference of the bedroll 100 and through the gap 400. The bedroll 100 and chop off roll 200 are concurrently rotated. The blades 240 and 140 mesh in the gap 400. The web material 300 is constrained to a path defined by the blade tips 142 and 242. The circumferential velocities of the bedroll 100 and chop off roll 200 are varied one from the other. The variance in velocities causes the blade tips 142 and 242 to move relative to each other changing the web path. Without being bound by theory, Applicants believe the web material 300 is stretched by the relative blade movement and subsequently fails at a line of weakness 310.

After the web material fails at a line of weakness 310, the downstream portion of the web material 300 proceeds through the converting process as the tail of the last separated portion of the web material 300. The web material portion may be wound in a roll or subjected to various other converting processes. The upstream portion of the separated web material 300 is the leading edge of the web material yet to be processed. The web pins 130 penetrate the upstream portion prior to the web separation to secure the upstream web and provide for consistent web handling of the upstream web.

The web pins 130 may each tear a small chad 500, of the web material 300 during web penetration. The chad 500 may be completely severed, or partially severed from the web material 300. As is known in the art, the web pin 130, together with the chad 500, penetrates the pin pad 230 and the chad 500 may become lodged in the pin pad 230. The accumulation of chads 500 impacted upon each other in the pin pad 230 may damage the web pins 130, and may reduce the service life of the pin pads 230. As shown in FIG. 3, Applicants' design for a pin pad 230 provides for the complete perforation of a portion of the pin pad 230 by the web pin 130 and the chad 500. The web pin 130 and chad 500 pass into, and completely through, a portion of the pin pad 230 into the chamber 236. The web pin 130 subsequently passes back through the pin pad 130, and the chad 500 is stripped away from the web pin 130. The chad 500 subsequently falls from the chamber as the chop off roll 100 rotates. The chads 500, do not accumulate and the useful service life of the pin pads is not adversely affected by an accumulation of chads 500.

While particular embodiments of the present invention have been illustrated and described, it would have been obvious to those skilled in the art that various other changes and modifications can be made without departing from the spirit and scope of the invention. It is therefore intended to cover in the appended claims all such changes and modifications that are within the scope of the invention.

What is claimed is:

1. An apparatus for separating a web material at a line of weakness, the apparatus comprising:

a) a bedroll having a circumference, the bedroll being disposed such that the web material passes around at least a portion of the circumference of the bedroll in a direction of travel, wherein the bedroll is disposed generally transverse to the direction of travel of the web material, the bedroll comprising a shell and a bedroll chop off assembly, the bedroll chop off assembly comprising at least one web pin having a distal portion and at least one bedroll blade having a distal portion and a serrated web contacting edge, the bedroll blade being disposed to extend axially along the bedroll in a direction generally transverse to the direction of travel of the web material, wherein the distal portions of the at least one bedroll blade and the at least one web pin are capable of extending beyond the shell of the bedroll, first rotating means for rotating the bedroll blade at a first circumferential velocity, b) a chop off roll disposed proximate and generally parallel to the bedroll, the chop off roll comprising at least one pin pad capable of circumferentially interfering with the at least one web pin, the chop off roll further comprising at least two chop off roll blades disposed to extend axially along the chop off roll in a direction generally transverse to the direction of travel of the web at a chop off roll blade spacing, the at least two chop off roll blades being capable of rotationally meshing with the at least one bedroll blade, second rotating means for rotating the at least two chop off roll blades at a second circumferential velocity, wherein the second circumferential velocity is distinct from the first circumferential velocity, and means for synchronizing the rotation of the bedroll blades and the rotation of the at least two chop off roll blades such that the blades rotationally mesh as they pass one another at the distinct velocities.

2. The apparatus of claim 1 wherein the bedroll comprises at least two bedroll blades disposed at a bedroll blade spacing.

3. The apparatus of claim 2 wherein the bedroll blade spacing is distinct from the chop off roll blade spacing.

4. The apparatus of claim 1 wherein the at least one web pin passes through at least a portion of the at least one pin pad.

5. The apparatus of claim 1 wherein the at least two chop off roll blades comprises three chop off roll blades.

6. The apparatus according to claim 1 wherein the at least one pin pad is capable of circumferentially interfering with at least one of the web pins, and wherein the at least two chop off roll blades comprise three chop off roll blades disposed to extend generally parallel each to the others and generally transverse to the direction of travel of the web, and wherein said chop off roll further comprises a plurality of web pads disposed generally along a line transverse to the direction of travel of said web, and wherein at least one of the three chop off roll blades is capable of rotationally meshing with the at least one bedroll blade.

* * * * *